United States Patent [19]

Tolfsen

[11] 4,196,499

[45] Apr. 8, 1980

[54] FASTENING MEANS FOR SAFETY BELTS

[76] Inventor: Ulf Tolfsen, Hannestad Øst 11, Skogholtet 15-32, 1713 Graalum, Norway

[21] Appl. No.: 878,378

[22] Filed: Feb. 16, 1978

[30] Foreign Application Priority Data

Feb. 25, 1977 [NO] Norway ..... 770636

[51] Int. Cl.[2] ..... A44B 11/26

[52] U.S. Cl. ..... 24/230 A; 200/61.58 B

[58] Field of Search ..... 24/230 A, 230 AL

[56] References Cited

U.S. PATENT DOCUMENTS

| | | | |
|---|---|---|---|
| 3,340,578 | 9/1967 | Straight | 24/230 A |
| 3,825,979 | 7/1974 | Takob | 24/230 A |
| 3,895,196 | 7/1975 | Lewis | 24/230 A |
| 3,955,056 | 5/1976 | Lindblad | 24/230 A |
| 4,068,354 | 1/1978 | Loomba | 24/230 A |

*Primary Examiner*—Bernard A. Gelak

*Attorney, Agent, or Firm*—Haseltine, Lake & Waters

[57] ABSTRACT

A fastening mechanism for a safety belt comprising a locking tongue attached to one end of a safety belt and a locking case attached to the other end of the safety belt. The case pivotably supports a locking flap which selectively engages the locking tongue to lock the same in the case or to release the locking tongue. A spring acts on the locking flap to urge the same to a locking position in which the locking tongue is engaged by the locking flap. An expeller is mounted in the case for displacement to expel the tongue from the case when the tongue has been released from the locking flap. A push button including an integral cam has a cam surface on which the locking flap is engaged under the action of the spring and displacement of the push botton displaces the cam and moves the locking flap to a release position with respect to the tongue. The cam has a slot in which the locking flap is engaged in the locking position and when the push button is displaced the locking flap rises up on the cam surface to release the locking flap and concurrently projections on the expeller pass beneath the raised locking flap to support the locking flap while the tongue is being expelled by the expeller.

7 Claims, 4 Drawing Figures

FASTENING MEANS FOR SAFETY BELTS

FIELD OF THE INVENTION

The present invention relates to an improved fastening means for safety belts for cars or the like, said fastening means being of the kind that comprises a so-called locking tongue and a locking flap.

PRIOR ART

Previously known fastening means of this kind comprises a locking tongue which is shaped to engage with a so-called locking flap arranged in the casing of said locking means. The connection between said locking tongue and said locking flap is usually released by a simple release means, such as a push button.

In the conventional fastening means, one disadvantage is that said locking tongue can become "wedged" by the locking flap in a half locked position so that the user is misled to believe that the locking tongue is in engagement with the locking flap.

Another disadvantage of the conventional fastening means is that both the locking flap and the locking tongue become worn due to friction between said parts, when the locking tongue is inserted and expelled. Such wear will gradually result in disturbed functioning of the fastening means. The critical value of the releasing force of the fastening means is, at present, stipulated at 12 kps, and the construction of conventional fastening means permits a release force somewhat below said critical value of 12 kps. It is expected that the critical value of the release force will be stipulated at approximately 6 kps in the near future. This will entail new requirements of the construction and performance of the fastening means.

A safety belt system is a safety system and as such it can never be safe enough. It is in connection with accidents and extreme strain that the safety system is put to the test, and the fastening means is an important component of the safety belt system. It is, thus, very important that the fastening means not fail in such a situation.

SUMMARY OF THE INVENTION

It is an object of the present invention to provide a fastening means for a safety belt for vehicles where the above mentioned disadvantages are eliminated and which additionally can satisfy the future requirements of a reduced release force for the fastening means.

Another object is to increase the strength and the security of the fastening means.

The above and further objects are achieved by the fastening means according to the present invention which comprises a locking tongue or insertion means attached to the safety belt and a casing containing the fastening mechanism and attached to the vehicle at a suitable place. The casing comprises a locking flap for locking said locking tongue; a locking spring in contact with and acting on said locking flap; a push button for releasing said locking tongue and an expelling means for expelling said locking tongue, said fastening means being characterized in that the extension of the push button consists of a cam the upper profile of which points away from said locking tongue and has a sloping curve which turns into an upright nose-like portion, the lower part of which has a notch or the like, into which one end of said locking flap slides and is locked; the expelling means comprising a spring-loaded expelling plate provided with one or more ribs to support said locking flap in a raised position until said fastening means is in a locked position.

BRIEF DESCRIPTION OF THE DRAWINGS

The invention will be disclosed in more detail with reference to the drawings, wherein.

DETAILED DESCRIPTION

Figure 1:
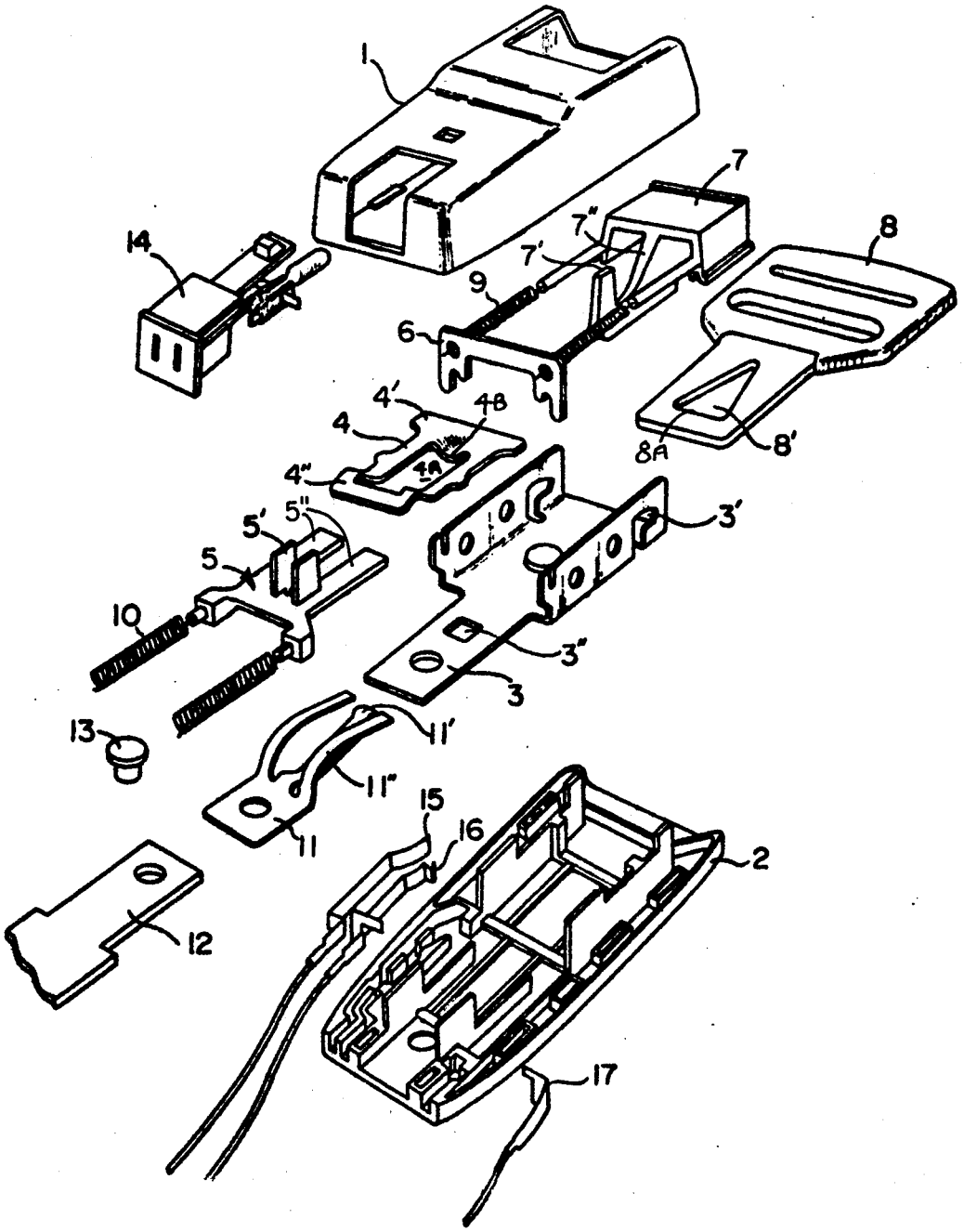
FIG. 1 is an exploded view of the fastening means showing the various components thereof.

Referring to FIG. 1, therein are seen the upper portion 1 of the fastening means and its lower part 2. Also shown is a locking case 3 secured to part 2 and a locking flap 4, the ears 4′ of which are inserted into recesses 3′ in the locking case 3 in an assembled state. The flap 4 is thereby pivotal in case 3. An expeller 5 is slidably mounted adjacent flap 4 for travel therebeneath and the expeller is provided with upstanding ribs 5′ and longitudinal fingers 5″. The expeller serves to expel a locking tongue 8 affixed to one of a safety belt and to pivotably raise the rear end of flap 4 as will be explained later. A reinforcing bridge 6 is secured to case 3 and is resiliently connected to a push button 7. The push button 7 has a cam 7″ with a nose-like portion 7′ at the end of the cam 7″. The flap 4 has a cutout 4A which receives the cam 7″ while the nose-like portion 7′ extends outside the flap and bears against the rear edge of rear portion 4″ of the flap 4.

The locking tongue 8 is provided with a recess 8′, the rear edge 8A of which, in a locked position, engages a downwardly bent lowered portion 4B of the locking flap 4. Push button springs 9 act on the push button to oppose displacement thereof. Expelling springs 10 act on expeller 5 to urge the same beneath flap 4 to cause the fingers 5″ to expel tongue 8. A locking spring 11 has a lower leaf 11′ which is passed through a recess 3″ in the locking case 3 and spring leaves 11″ which rest on the rear portion 4″ of locking flap 4.

A fastening yoke 12 connected to the other end of the safety belt is secured by a rivet 13 to spring 11 and case 3.

A bulb insert 14 is also shown and can easily be removed from or inserted into the locking case. A blade contact 15 delivers current for a warning light and/or sound signal. A blade contact 17 delivers current to a bulb in the insert 14 and a blade contact 16 is connected to ground.

Figure 2:
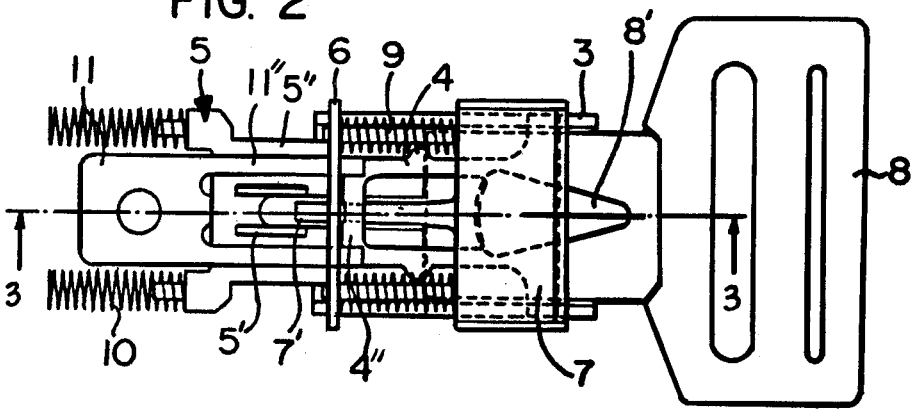
FIG. 2 is a horizontal sectional view of the fastening means in a locked position.
Figure 3:
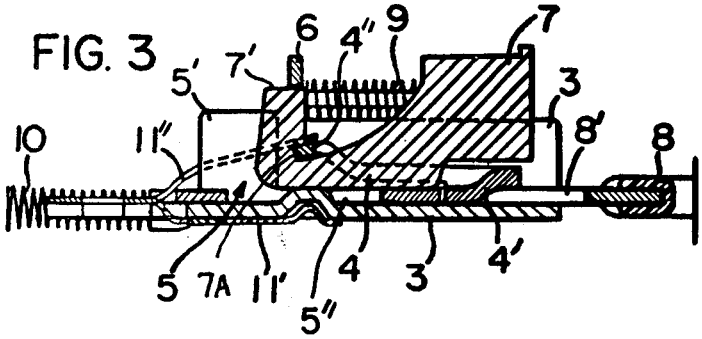
FIG. 3 is a sectional view of the fastening means taken along line 3—3 in FIG. 2.

FIGS. 2 and 3 show the fastening means in a locked position. Therein, the locking tongue 8 is locked by the downwardly bent portion 4B of the locking flap 4. The expeller 5 is urged backwards against the action of springs 10 by locking tongue 8. Locking flap 4 is urged downwardly by spring leaves 11″ and the push button 7 is in its locking position, the rear edge 4″ of locking flap 4 engaging in a notch 7A in the nose 7′ of the push button 7 at the juncture with the cam surface 7″.

Figure 4:
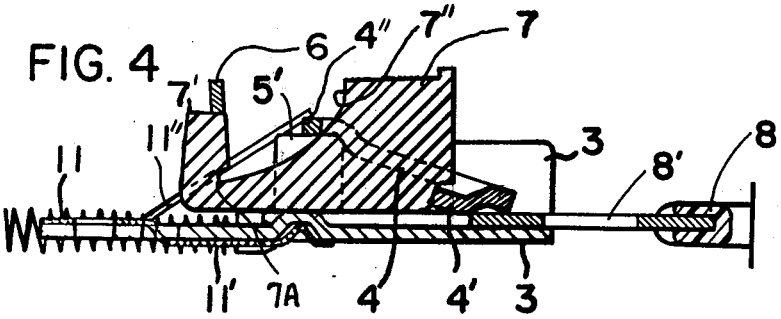
FIG. 4 is a vertical section of the fastening means in an open non-locked position.

FIG. 4 is a vertical section of the locking case in an open, non-locked position. Bent portion 4B of locking flap 4 is released from recess 8′ in tongue 8. The rear edge 4″ of flap 4 rests on the two vertical ribs 5′ of the expeller 5. Push button 7 is slightly displaced rearwardly from its locking position and nose 7′ is urged against the raised rear edge 4″ of the locking flap 4. The leaves 11 of locking spring 11 bear against the rear edge 4″ of locking flap 4. Locking tongue 8 has been expelled outside the fastening means by the action of the expeller 5.

The construction of the push button 7 effectively provides a cam that slides under and gradually raises the locking flap from its locked position when the push button is pushed inwardly. Consequently, the releasing force will be substantially reduced as compared with the releasing force that had to be used heretofore in connection with conventional fastening means. The curved surface on the cam 7″ is shaped so as to provide a favorable raising force on the locking flap when the push button is pushed inwardly. The curved surface slopes upwardly away fron nose 7′ and is concave.

As shown, the locking flap is disengaged when the locking tongue 8 is inserted in a subsequent seat belt engaging operation. The flap is kept disengaged by the shape of the expeller with its vertical ribs 5′. In this manner any wear of the locking tongue and the locking flap is avoided. In conventional fastening means friction between said parts will cause wear.

In operation, when the locking tongue 8 is inserted into the fastening means, the tongue contacts expeller 5 causing retraction thereof to withdraw ribs 5′ from beneath rear portion 4″ of flap 4. The flap 4 is now free to be lowered by leaves 11″ so that the downwardly bent portion 4B can engage in recess 8′ to abut against the rear edge 8A and lock the tongue 8. Concurrently, the rear portion 4″ engages in the slot 7A in nose 7′ to become locked therein. Only when the push button 7 is pushed inwardly will the rear portion 4″ come out of the slot 7A and ride up the cam 7″ to release the downwardly bent portion 4B from recess 8′ and enable expeller 5 to advance and expel the tongue 8 while the ribs 5′ pass under the rear portion 4″ of flap 4.

In the locked position, the locking flap 4 is locked by the slot 7A in the nose-like portion 7′ of the push button. This ensures additional safety when the safety belt is engaged. The bridge 6 may be regarded as a reinforcing element, giving further protection to the fastening means against detrimental external influences.

With the fastening means according to the invention, the use of screws, rivets or the like has been eliminated for mounting and assemblage of the fastening means.

What is claimed is:

1. Fastening means for a safety belt comprising a locking tongue adapted for being attached to one end of a safety belt, a locking case adapted for being attached to the other end of the safety belt, locking flap means displaceably supported by said case for selectively engaging said locking tongue to lock the same in said case and for releasing the locking tongue, spring means acting on said flap means for urging the flap means to a locking position in which the locking tongue is engaged by the flap means, expeller means movably mounted in said case for expelling the tongue from the case with said tongue released from the flap means, push button means acting on said flap means for displacing the flap means to a released position, in opposition to said spring means, in which the flap means is released from said tongue, said push button means including a cam means having a cam surface on which said flap means is engaged under the action of said spring means, said push button means being displaceable to cause said flap means to ride up on said cam surface and release the flap means from engagement with the tongue, said cam surface having an upper profile which has a sloping concave curve in a direction away from said push button, said cam surface having a lower portion provided with a slot in which said flap means is engaged in the locking position, said cam means having a lower planar portion which slidably rides on said locking case, said expeller means including projection means for passing beneath the raised flap means to support the flap means while the tongue is being expelled by the expeller means and to hold said flap means in a raised position when said fastening means is not engaged.

2. Fastening means as claimed in claim 1 wherein said cam means is integral with said push button means.

3. Fastening means as claimed in claim 1 wherein said projection means comprises two upstanding ribs on said expeller means.

4. Fastening means as claimed in claim 1 wherein said cam means comprises a nose portion extending upwardly at the lower end of the concave curved cam surface, said slot being provided in said nose portion at the juncture thereof with the cam surface.

5. Fastening means as claimed in claim 4 wherein said tongue has a recess, said flap means comprising a flap member including a downwardly bent portion engaging in said recess in the locked position, said flap member having a front end pivotably coupled to said case and a rear end in contact with the cam surface and engageable in said slot.

6. Fastening means as claimed in claim 5 wherein said flap member has a cut-out through which said cam means extends such that the rear end of the flap member rests on the cam surface with the nose portion in contact with the rear edge of said rear end.

7. Fastening means as claimed in claim 1 comprising a reinforcing bridge connected to said case and resiliently coupled to said push button means.

* * * * *